United States Patent [19]

Ikeura

[11] 4,406,261

[45] Sep. 27, 1983

[54] INTAKE AIR FLOW RATE CONTROL SYSTEM FOR AN INTERNAL COMBUSTION ENGINE OF AN AUTOMOTIVE VEHICLE

[75] Inventor: Kenji Ikeura, Yokosuka, Japan

[73] Assignee: Nissan Motor Company, Limited, Kanagawa, Japan

[21] Appl. No.: 152,094

[22] Filed: May 21, 1980

[30] Foreign Application Priority Data

May 25, 1979 [JP] Japan ..... 54-64840

[51] Int. Cl.[3] ..... F02D 11/10

[52] U.S. Cl. ..... 123/339; 180/170; 123/328; 123/340; 74/850

[58] Field of Search ..... 123/340, 339, 328; 180/170; 74/850

[56] References Cited

U.S. PATENT DOCUMENTS

| | | | |
|---|---|---|---|
| 3,603,297 | 9/1971 | Sherwin | 123/328 |
| 3,670,708 | 6/1972 | Ojala | 123/339 |
| 3,753,427 | 8/1973 | Cedar | 123/328 |
| 3,996,904 | 12/1976 | Kobuki | 123/328 |
| 4,079,711 | 3/1978 | Hattori et al. | 123/339 |
| 4,084,563 | 4/1978 | Hattori et al. | 123/339 |
| 4,146,000 | 3/1979 | Hattori et al. | 123/339 |
| 4,155,335 | 5/1979 | Hosaka | 123/339 |
| 4,186,697 | 2/1980 | Yasuda | 123/339 |
| 4,203,395 | 5/1980 | Cromas | 123/339 |
| 4,237,833 | 12/1980 | Des Lauriers | 123/339 |
| 4,237,838 | 12/1980 | Kinugawa | 123/339 |
| 4,240,145 | 12/1980 | Yano | 123/339 |
| 4,242,994 | 1/1981 | Keely | 123/339 |
| 4,291,656 | 9/1981 | Miyagi | 123/339 |
| 4,336,779 | 6/1982 | Semence | 123/339 |

FOREIGN PATENT DOCUMENTS

| | | | |
|---|---|---|---|
| 1339404 | 12/1973 | United Kingdom | 123/339 |
| 1470642 | 4/1977 | United Kingdom | 123/339 |
| 1546880 | 5/1979 | United Kingdom | 123/339 |
| 1547915 | 6/1979 | United Kingdom | 123/339 |

*Primary Examiner*—Ronald B. Cox

*Attorney, Agent, or Firm*—Lowe, King, Price & Becker

[57] ABSTRACT

Disclosed herewith an intake air flow rate control system for an internal combustion engine including a means for detecting acceleration and deceleration of the vehicle and controlling the air flow rate in response to required air flow rate which is varied by acceleration and deceleration of the vehicle. The means temporarily operates to vary the air flow rate at the time of acceleration or deceleration in which the throttle valve angle sensor turns between on to off or off to on. After increasing or decreasing the air flow rate responsive to acceleration or deceleration of the vehicle, the increased or decreased value is gradually returned to the normal control ratio at a given rate and a given timing.

14 Claims, 2 Drawing Figures

INTAKE AIR FLOW RATE CONTROL SYSTEM FOR AN INTERNAL COMBUSTION ENGINE OF AN AUTOMOTIVE VEHICLE

BACKGROUND OF THE INVENTION

1. Field of the Invention

The present invention relates generally to an intake air flow rate control system for an internal combustion engine of an automotive vehicle. More specifically, the present invention relates to a control system for controlling an intake air flow rate in the engine idling condition, wherein the vehicle's transient operating characteristics can be improved in response to variation of required air flow rate corresponding to variation in throttle valve angle of the vehicle.

2. Description of the Prior Art

In recent years, pollution of the atmosphere by nitrogen oxides $NO_x$, carbon monoxide CO, gaseous sulfurous acid and the like, as produced in the exhaust gas of automotive vehicles, has become a serious social problem. In addition to this, the price of fuel, i.e. gasoline or petrol, for automotive vehicles has become higher and higher, because of the limited resources thereof. For preventing atmospheric pollution caused by exhaust gases of automotive vehicles and for economic usage of fuel, it has become necessary for current automotive vehicles to control engine speed accurately even when the vehicle engine is idling.

In an air flow rate control system, when the vehicle starts driving after idling, required air flow rate through an idle port passage and a bypass passage for delivery to the intake manifold of the internal combustion engine is considerably increased. On the other hand, when the vehicle is rapidly decelerated and therefor the throttle valve is completely closed, required air flow rate is increased a considerable rate. For the conventional control system, it is impossible to follow such substantial changes in required air flow rate. Therefore, response to change of the required air flow rate is necessarily delayed. Indeed, in the conventional system, the air flow rate is varied gradually at a given rate to follow the change of required air flow rate. However, when the difference of the air flow rate between the present rate and the required rate is quite large, particularly when the required rate is too large relative to the present rate, it is impossible for the conventional system to follow the changed requirements rapidly. Therefore, conventional systems may possibly cause engine stalling under such circumstances.

On the other hand, in situations of response to increased air flow rate corresponding to rapid deceleration of the vehicle, and therefore in response to closure of the throttle valve, various systems have been developed to improve response characteristics corresponding to change of required air flow rate, such as a so-called dash-pot system. In the conventional system, the throttle valve is provided with a bypass passage with a valve means which is opened in response to excessive intake vacuum in the intake manifold. In this system, the vacuum in the intake manifold is measured sequentially and when the vacuum reaches a given value, a control command is applied to open the valve means to deliver the intake air through the bypass passage. However, in such a system, since the control for adjusting the air flow rate is made in response to exceeding of the air flow rate relative to that of required, delay of response is an inherent characteristic.

The present invention is intended to solve the above-mentioned difficulties or disadvantages in the prior art by providing an improved system for responding to varying of required air flow rate.

SUMMARY OF THE INVENTION

Therefore, it is an object of the present invention to provide an intake air flow rate control system having an improved response characteristics for varying the air flow rate to correspond to required air flow rate due to accelerating or decelerating the vehicle.

Another and a specific object of the present invention is to provide means for temporarily controlling air flow rate through the idle port and/or the bypass passage in response to opening and closing of the throttle valve.

According to the present invention, there is provided an intake air flow rate control system for an internal combustion engine including means for detecting an engine driving condition and for controlling the air flow rate in response to required air flow rate which is varied by the engine driving condition. The means temporarily operates to vary the air flow rate at the time of acceleration or deceleration in which the throttle valve angle sensor turns from ON to OFF or from OFF to ON.

Preferably, after once operating the means to control the air flow rate so as to adapt to the required rate, the increased value is gradually returned to the normal control ratio at a given rate and a given timing.

The other objects and advantage sought in the present invention will become more apparent from descriptions given hereinbelow.

BRIEF DESCRIPTION OF THE DRAWINGS

The present invention will become more fully understood from the detailed description given below, and from the accompanying drawings of the preferred embodiment of the present invention, which, however, is not be taken as limitative of the present invention in any way, but is for the purpose of clarification and explanation only.

In the drawings.

DESCRIPTION OF THE PREFERRED EMBODIMENT

Figure 1:
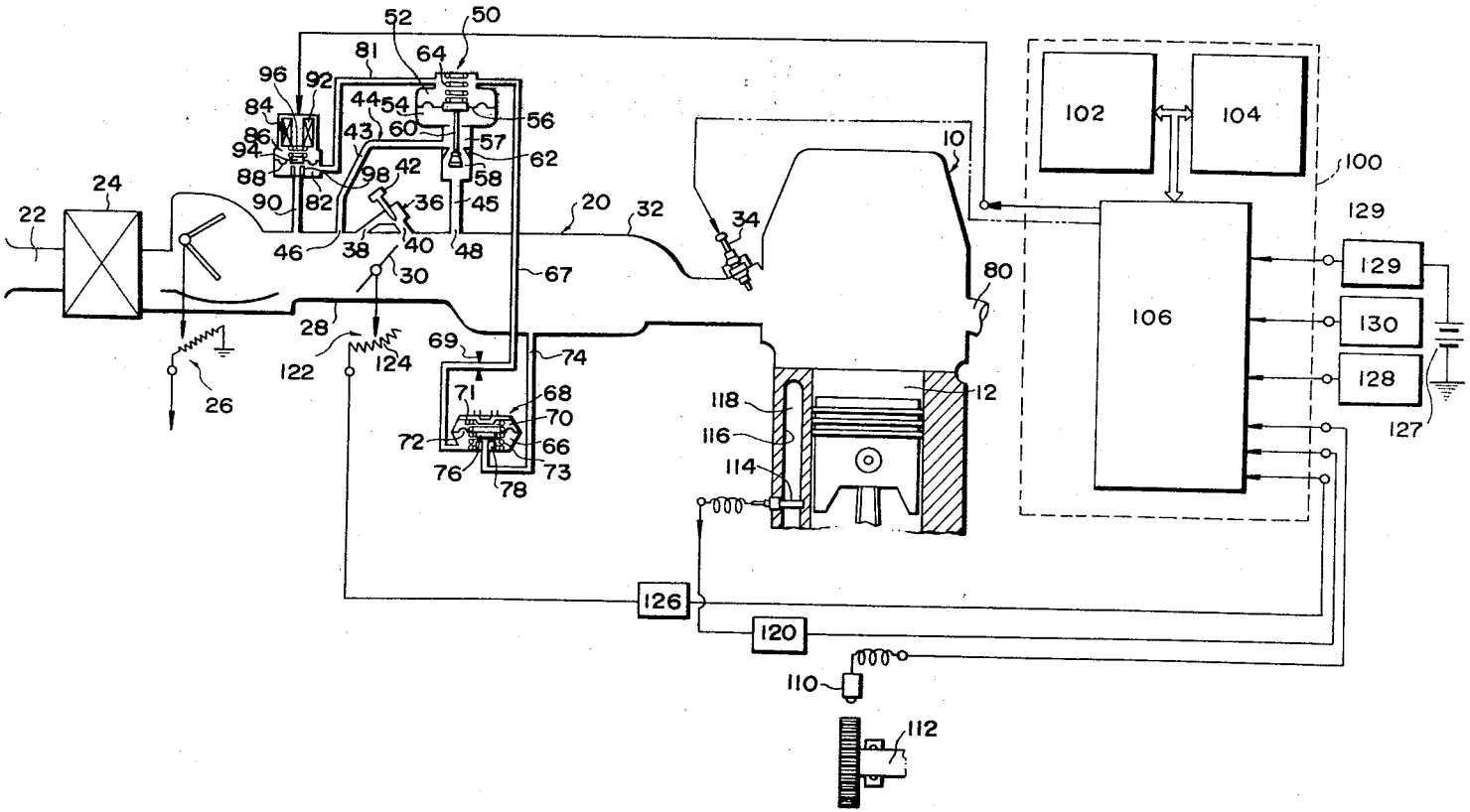
FIG. 1 is a diagramatical illustration of an intake air flow rate control system for an internal combustion engine according to the preferred embodiment of the present invention.

Referring now to the drawings, and particularly to FIG. 1, there is shown the general construction of an internal combustion engine having a computer controlled fuel injection system to be provided on an automotive vehicle. An air flow rate control system according to the present invention is shown in conjunction with the specific internal combustion engine as an example and for the purposes of explanation only, and should not be taken as limitative of the scope of the present invention. Before proceeding with a detailed description of the invention, it should be appreciated that the air flow rate control system according to the present invention will be applicable to any type of internal combustion engine which can be controlled by a microcomputer mounted on the vehicle.

In FIG. 1, each of the engine cylinders 12 of an internal combustion engine 10 communicates with an air intake passage generally designated by 20. The air intake passage 20 comprises an air intake duct 22 with an air cleaner 24 for cleaning atmospheric air, an air flow meter 26 provided downstream of the air intake duct 22 to measure the amount of intake air flowing therethrough, a throttle chamber 28 in which is disposed a throttle valve 30 cooperatively coupled with an accelerator pedal, not shown, so as to adjust the flow rate of intake air flowing therethrough, and an intake manifold 32 having a plurality of branches not clearly shown in FIG. 1. Although not clearly illustrated in FIG. 1, the air flow meter is incorporated with another engine control system which determines fuel injection rate, for example. A fuel injector 34 is provided on the intake manifold 32. The rate of injection of fuel through the fuel injector 34 is controlled by an adjusting device, such as, an electromagnetic actuator (not shown). The adjusting device is electrically operated by the other engine control system which determines fuel injection rate, fuel injection timing and so on, corresponding to engine condition sensed by various engine parameter sensing means. It should be noted that, although the fuel injector 34 is disposed on the intake manifold 32 in the shown embodiment, it is possible to locate it in the combustion chamber 12 in a well known manner.

An idle port passage 36 is provided opening into the throttle chamber 28. One end port 38 of the idle port passage 36 opens upstream of the throttle valve 30, and the other end port 40 opens downstream of the throttle valve 30, so that the idle port passage 36 bypasses the throttle valve 30. An idle adjusting screw 42 is provided in the idle port passage 36. The idle adjusting screw 42 is manually operable so as to adjust the flow rate of intake air flowing through the idle port passage 36. A bypass passage 44 is also provided to the intake air passage 20. One end 46 of the bypass passage 44 opens between the air flow meter 26 and the throttle valve 30 and the other end 48 opens downstream of the throttle valve 30, adjacent to the intake manifold 32. Thus the bypass passage 44 bypasses the throttle valve 30 and connects the section upstream of the throttle valve 30 to the intake manifold 32. An idle control valve, generally designated by 50, is provided in the bypass passage 44. The idle control valve 50 generally comprises two chambers 52 and 54 separated by a diaphragm 56. The chamber 54 communicates with the atmosphere (not shown). The bypass passage 44 is thus separated by the valve means 50 into two portions 43 and 45 respectively located upstream and downstream of the port 57 of the valve 50. The valve means 50 includes a poppet valve 58 disposed within the portion 57 in a manner that it is movable between two position. In one position the valve is opened to establish communication between the portions 43 and 45 of the passage 44, and in the other the valve is closed. The poppet valve element 58 has a stem 60 whose end is secured to the diaphragm 56 so as to cooperatively move therewith. The diaphragm 56 is biased downwards in the drawing, so as to release the valve element 58 from a valve seat 62, by a helical compression coil spring 64 disposed within the chamber 52 of the valve means 50. Thereby, the valve 50 is normally opened, and normally communicates the portions 43 and 45 of the bypass passage 44 to one another, via its valve port 57.

The chamber 52 of the idle control valve 50 communicates with one chamber 66 of a pressure regulating valve 68 as the constant vacuum source through a vacuum passage 67. The pressure regulating valve 68 is separated into two chambers 66 and 70 by a diaphragm 72. The chamber 66 of the pressure regulating valve 68 also communicates with the intake manifold 32, so as to introduce vacuum from the intake manifold 32 thereinto, through a passage 74. The chamber 70 is open to the atmosphere in a well known manner. To the diaphragm 72 is secured a valve member 76 which is opposed to a valve seat 78 provided at the end of the passage 74. In the chambers 66 and 70 there are respectively disposed helical compression coil springs 71 and 73. The springs 71 and 73 are generally of equal spring pressure in a position in which the diaphragm 72 is in neutral position. It will be noted that, though it is not so shown, the chamber 66 can also be connected with an exhaust-gas recirculation (EGR) control valve which recirculates a part of the exhaust gases flowing through an exhaust passage 80 to the intake manifold 32.

The diaphragm 72 is moved upwards or downwards by change of the balance of the vacuum in the chamber 66 and the atmospheric pressure introduced into the chamber 70. By this movement of the diaphragm 72, the valve member 76 is moved toward or away from the valve seat 78, so as to regulate a reference vacuum for the idle control valve 50. The reference vacuum regulated in the pressure regulating valve means 68 is introduced to the chamber 52 of the idle adjusting valve means 50 through the vacuum passage 67 with an orifice 69. The orifice 69 restricts varying of vacuum flowing into the chamber 52 so as to smooth the valve operation.

The chamber 52 of the idle control valve 50 is further communicated with a chamber 82 of an intake air valve 84 through an air passage 81. The intake air valve means 84 is divided into two chambers 82 and 86 by a diaphragm 88. The chamber 82 is also communicated with the air intake passage 20 upstream of the throttle valve 30 through a passage 90. An electromagnetic actuator 92 is disposed within the chamber 86 and is electrically operated in response to a train of pulse signals generated based on a control signal from the control signal generator in a hereinafter described control unit in use with a microcomputer. On the diaphragm 88 is provided a valve member 94 which is electromagnetically moved by the actuator 92. In practice, by varying the width, i.e. the pulse duty cycle of the pulse signal, based on the control signal, the ratio of the energized period and deenergized period of the actuator 92 is varied. The pulse duty is a ratio of the time period of the ON-pulse to the period of one cycle of the pulse signal. Therefore the ratio of the opening period and the closing period of the valve 94 is varied so as to control the flow rate of the air flowing through the intake air valve 84. In the chamber 86 there is further provided a helical compression coil spring 96 which biases the diaphragm together with the valve member 94 toward the end of the passage 90, so as to seat the valve member 94 onto a valve seat 98 provided at the end of the passage 90. By the vacuum from the pressure regulating valve 68, the diaphragm 56 together with the valve element 58 are moved to control the flow of air through the bypass passage 44. The vacuum in the chamber 52 is controlled with controlling the flow rate of the air flowing through the intake air valve 84 and the air passage 81.

When the internal combustion engine 10 is in an idling condition, the throttle valve 30 is generally closed so as to ristrict the flow of intake air therethrough. Therefore, during idling of the internal combustion engine 10, the intake air substantially flows through both the idle port passage 36 and the bypass passage 44, which bypass the throttle valve 30 and connect the upstream and the downstream areas of the throttle valve 30. Air flow rate through the idle port passage 36 is adjusted by the idle adjusting screw 42, and the air flow rate through the bypass passage 44 is generally controlled by the idle control valve 50. The idle control valve 50 is operated by vacuum fed from the intake manifold 32 through the passage 74, the pressure regulating valve 68, and the vacuum passage 67. The vacuum in the chamber 52 is adjusted by the atmospheric intake air flowing thereinto through the passage 90, the electromagnetic valve 84 and the passage 81. The valve element 58 is operated to control the air flow rate through the passage 44 by the vacuum within the chamber 52. Since the engine speed depends on the intake air flow rate, it can thus be controlled by controlling the air flow rate through the idle port passage 36 and the bypass passage 44 when the internal combustion engine 10 is in the idling condition.

The control operation for adjusting the intake air flow rate performed by controlling the electromagnetic actuator 92 is described hereinafter. The controlling of air flow rate, and thus the control of engine speed during idling of the internal combustion engine 10, can also be carried out by adjusting the idle adjusting screw 42. The idle adjusting screw 42 is controlled manually so as to set the initial engine idling speed.

Now, returning to FIG. 1, a microcomputer 100, employed for automatically controlling the air flow rate, comprises generally a central processing unit (CPU) 102, a memory unit 104, and an input/output unit 106 i.e. an interface. As inputs of the microcomputer 100, there are provided various sensor signals, such as:

- a crank pulse and a crank standard pulse, the crank pulse being generated at every one degree, or at other predetermined increments of the crank angle, and the crank standard pulse being generated at every given crank standard angle by a crank angle sensor 110 detecting the amount of rotation of a crank shaft 112; the crank pulse and the crank standard pulse are input as an input indicating engine speed and engine crank position;
- a coolant temperature signal, produced by a temperature sensor 114 which is inserted into a coolant passage 116 provided around the engine cylinder 112, and exposed to the coolant 118; the temperature sensor 114 generates an analog signal in response to the coolant temperature and feeds this signal to the input/output unit 106 through an analog-digital converter (A/D converter) 120, in which the coolant temperature signal is converted into a digital code i.,e. a binary number signal, which is suitable as an input for the microcomputer;
- a throttle valve angle signal, derived from an analog signal produced by a throttle valve angle sensor 122 which comprises a variable resistor 124 and converted into digital code by an A/D converter 126,
- a signal from a transmission neutral switch 128, which is input in the form of an ON/OFF signal,
- a vehicle speed signal, fed from a vehicle speed sensor 130, which is an ON/OFF signal which becomes ON when the vehicle speed is lower than a given speed, e.g., 8 kph, and is OFF otherwise, and a battery voltage signal, fed from the battery 127 through the A/D converter 129.

It will be appreciated that, although, in the shown embodiment there is employed a variable resistor 124 in the throttle valve angle sensor 122 for detecting the closed position of the throttle valve, an ON/OFF switch could substitute for the variable registor 124, which could become ON when the throttle valve 30 is in the closed position.

In the air flow rate control system according to the present invention, either feedback control or open loop control is selectively carried out corresponding to engine driving condition. In open loop control, a control signal which determines the pulse signal to be applied to the actuator 92 is determined corresponding to the engine coolant temperature measured by the coolant temperature sensor 114. On the other hand, in feedback control, the control signal is determined corresponding to an actual engine speed and a difference between the actual engine speed and a reference engine speed. In the present application, the word "actual engine speed" should be understood as an engine revolution rate within a unit time, in which the rate is measured and determined based on a signal from the crank angle sensor 110. Further, the word "reference engine speed" should be understood as a target engine revolution rate within a unit time, in which the rate is basically determined corresponding to the engine coolant temperature and is corrected with control parameters indicative of engine driving condition.

The intake air flow rate will be corrected under the specific driving condition that the throttle valve angle sensor 122 detects the throttle valve being opened, and further detects that the transmission is in driving range, the vehicle speed exceeds 8 km/h, the coolant temperature is higher than 74° C. and that open loop control is being carried out. The correction of the control signal is carried out by way of table look up with respect to the following correction table relative to the engine speed:

TABLE

| Engine Speed (r.p.m.) | Correction Value (%) | Engine Speed (r.p.m.) | Correction Value (%) |
|---|---|---|---|
| 0 | 0 | 1600 | 8.5 |
| 200 | 0 | 1800 | 13 |
| 400 | 0 | 2000 | 17 |
| 600 | 0 | 2200 | 22 |
| 800 | 0 | 2400 | 30 |
| 1000 | 0 | 2600 | 35 |
| 1200 | 0 | 2800 | 40 |
| 1400 | 3.5 | 3000≧ | 45 |

In the above table, the percentage of the correction value corresponds to the ratio of the increased part of the duty cycle by correction to the one cycle of a pulse, when the one cycle of a pulse is assumed to be 100%.

In the correcting operation by table look up, when the engine speed is intermediate between two of the given speeds the correction rate will be obtained by interpolation in known manner.

Figure 2:
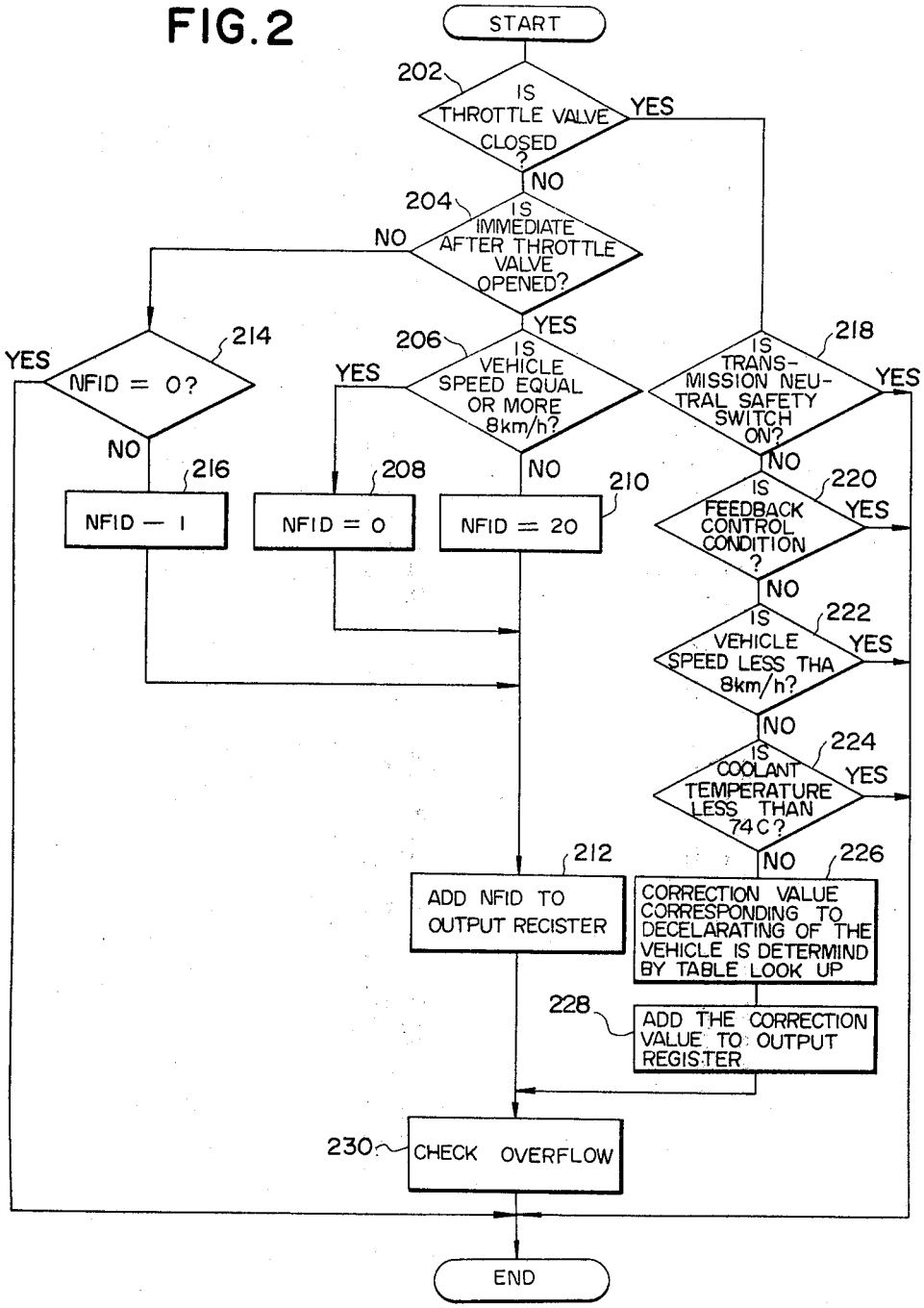
FIG. 2 is a flowchart of a program to be executed by a microcomputer so as to adjust the control signal in response to acceleration or deceleration of the vehicle.

Now referring to FIG. 2, there is illustrated a flowchart of a program to be excecuted to correct the control signal and thereby to correct the air flow rate in response to acceleration and deceleration of the vehicle. When the vehicle speed is more than 8 km/h and additionally but essentially, the throttle valve is opened, this program is executed to correct the control signal.

At first, the throttle valve angle sensor signal is checked whether the throttle valve is in closed position, at a decision block 202. When the throttle valve is opened and therefore the decision of the block 202 is NO, the condition is checked at a decision block 204 to determine whether the throttle valve was opened in the immediate past. If so, at a decision block 206, the vehicle speed is checked to determine if it is equal to or more than 8 km/h. When the vehicle speed is equal to or more than 8 km/h, the incremental or increasing correction rate NFID for the control signal is set to 0 at a block 208. While, if the vehicle speed is less than 8 km/h and therefore, the decision of the block 206 is NO, the incremental correction rate NFID is set to 20 at a block 210. The correction rate NFID determined at the either block 208 or 210 is added to a value of the control signal to be sent out to the output register at a block 212. The duty cycle is determined based on the control signal in the output register. Therefore the duty cycle is increased corresponding to the increase of the value of the control signal.

When the decision of the block 204 is NO, i.e., the time of decision at the block 204 is not immediate after the throttle being opened, the correction rate NFID is checked at a decision block 214 to determine whether it is 0. If the decision of the block 214 is YES, then the process of the program goes to the end of the program. Otherwise, the correction rate NFID is decremented by 1 at a block 216 and thereafter added to the value of the control signal to be sent out to the output register at the block 212.

On the other hand, if the throttle valve is in a closed position, and therefore, the decision at the block 202 is YES, the transmission neutral switch is checked at a decision block 218 to determine whether it on. If the decision at the block 218 is NO, then decision block 220 checks whether the control is carried out by feedback control. When the decision at the block 220 is NO, the vehicle speed is checked at a decision block 222 to determine whether it is less than 8 km/h a decision block 222. If the vehicle speed is equal to or more than 8 km/h, and therefore, the decision at the block 222 is NO, the coolant temperature is checked to determine whether it is or is not less than 74°, at a decision block 224. If the decision at the block 224 is NO, the table for determining the correction rate corresponding to deceleration of the vehicle is looked up to determine the correction rate corresponding to the engine speed, at a block 226. Thereafter, the correction rate determined at the block 226 is added to the value of the control signal to be sent out to the output register at a block 228.

Meanwhile, if any of the decisions at the blocks 218, 220, 222 and 224 is YES, the program goes to the end.

After processing at the block 212 or 228, the value of the control signal to be sent out to the output register is checked with respect to overflow, at a block 230.

The numerical value "1" of the correction rate NFID corresponds to the 0.5% increase of the pulse duty of a pulse signal applied to the actuator 92. Therefore, when the correction rate is determined by increment 20 at the block 210, the pulse duty is actually incremented by 10% of the one pulse cycle which is 100%. The incremented pulse duty is thereafter decreased gradually by decreasing the value of the control signal gradually. The blocks 214 and 216 provide a process for gradually decreasing the incremented value of the control signal until the correction rate NFID becomes 0. Namely, in the shown embodiment, the incremented value of the control signal is decreased by 1 for correction of the ratio NFID at the block 216, which means that the incremented pulse duty is decreased at a rate of 0.5%. Therefore, after incrementation of the pulse duty in response to opening of the throttle valve, the incremented pulse duty is decreased step by step at a rate of 0.5% per step and the correction rate is made to equal 0 by 20 iterations of the program. Here, since, generally, the program is executed per 1 cycle of engine revolution, the increased pulse duty is returned to normal rate after 20 cycles of the engine revolution. By this approach, the present control system can fullfill the requirement for increasing of the intake air flow rate upon starting driving and for preventing engine stalling due to lack of the air flow rate by gradually reducing the incremented correction rate.

On the other hand, when the vehicle is rapidly decelerated, the correction value rate of the duty cycle is determined at the block 226. Actually, at the block 226, the correction value of the control signal is determined, and based on the corrected value of the control signal the duty cycle is determined. For detecting decelerating the vehicle, the driving condition is checked at respective blocks 218, 220, 222 and 224. When the transmission neutral switch is ON, i.e., the transmission is in neutral range, and thus an engine brake condition will not arise, it is unnecessary to correct the duty cycle. If the neutral switch is OFF but feedback control is taking place, it is also unnecessary to correct the duty cycle, since the pulse duty cycle will be corrected by the feedback control operation corresponding to the actual engine speed and the difference between the actual engine speed and the reference engine speed. If in such condition, a further correcting operation is to take place, it will cause an excessive increase of the pulse duty cycle. Further, when the vehicle speed is less than 8 km/h, an engine braking condition will also not arise. In this situation, even if the throttle valve is closed and the neutral switch is OFF, the indication is that the vehicle is being decelerated without engine braking. Additionally, when the coolant temperature is lower than 74° C., correction of the duty cycle will take place corresponding to the coolant temperature. Therefore, it is unnecessary to increment the duty cycle depending on deceleration of the vehicle. As stated above, if the combination of conditions occurs wherein the neutral switch is OFF, the feedback control is not taken place, vehicle speed is equal to or more than 8 km/h and the coolant temperature is equal to or higher than 74° C., then correction by table look up takes place at the block 226. However, although in the shown embodiment the correction rate is determined by table look up, it will be possible to obtain the correction rate otherwise, for example by using, a formula indicative of function relative to the actual engine speed.

While the specific construction is disclosed hereinabove for illustration of the present invention, it will be possible to provide various modification for various features or elements which comprise the present invention. Therefore, the present invention should not be limited to the specific embodiment given above and should be understood to include any modifications which do not depart from the principle of the present invention.

What is claimed is:

1. An intake air flow rate control system for an internal combustion engine, in which either feedback control or open loop control for controlling auxiliary air flow rate is selectively carried out corresponding to an engine driving condition, said system including an auxiliary air flow rate control valve means with an actuator being operative in response to a control signal applied thereto, wherein said system comprising:

an engine coolant temperature sensor for detecting engine coolant temperature and producing an engine coolant temperature signal indicative of the detected engine coolant temperature;

a throttle angle sensor responsive to a throttle valve angular position smaller than a predetermined open angle for producing a throttle angle signal;

a first means for determining a control value in open loop control based on the engine coolant temperature signal and for providing to said control signal a duty cycle indicative of said control value for controlling the ratio of energized and deenergized periods of said actuator, said control signal being provided a particular duty cycle as an initial value;

a second means, responsive to said throttle angle signal, for correcting said control value in response to variation of the throttle valve angular position, said second means correcting said control value for increasing said duty cycle of said control signal at a given rate responsive to an opening of said throttle valve exceeding said predetermined open angle and for thereafter gradually decreasing said increased duty cycle of said control signal at a given rate and a given timing until the duty cycle returns to its initial value.

2. An intake air flow rate control system for an internal combustion engine, in which either feedback control or open loop control for controlling auxiliary air flow rate is selectively carried out corresponding to an engine driving condition, said system including an auxiliary air flow rate control valve means with an actuator being operative in response to a control signal applied thereto, wherein said system comprising:

an engine coolant temperature sensor for detecting an engine coolant temperature and producing an engine coolant temperature signal indicative of the detected engine coolant temperature;

a throttle angle sensor responsive to a throttle valve angular position smaller than a predetermined open angle for producing a throttle angle signal;

a first means for determining a control value in open loop control based on the engine coolant temperature signal and for providing to said control signal a duty cycle indicative of said control value for controlling the ratio of energized and deenergized periods of said actuator, said control signal being provided at a particular duty cycle as an initial value;

a second means, responsive to said throttle angle signal, for correcting said control value in response to variation of the throttle valve angular position, said second means correcting said control value for increasing said duty cycle of said control signal at a given rate, which correction rate is a function of engine speed, responsive to a closing condition of said throttle valve angular position in which the angular position of said throttle valve is smaller than the predetermined open angle, and for thereafter decreasing said increased duty cycle of said control signal at a given rate and a given timing until the duty cycle returns to its particular initial value.

3. An intake air flow rate control system for an internal combustion engine, in which either feedback control or open loop control for controlling auxiliary air flow rate is selectively carried out corresponding to an engine driving condition, said system including an auxiliary air flow rate control valve means with an actuator being operative in response to a control signal applied thereto, wherein said system comprising:

an engine coolant temperature sensor for detecting an engine coolant temperature and producing an engine coolant temperature signal indicative of the detected engine coolant temperature;

a throttle angle sensor responsive to a throttle valve angular position smaller than a predetermined open angle for producing a throttle angle signal;

an engine speed sensor for detecting engine speed and producing an engine speed signal indicative of the detected engine speed;

a first means for determining a control value in open loop control based on the engine coolant temperature signal and for providing to said control signal a duty cycle indicative of said control value for controlling the ratio of energized and deenergized periods of said actuator, said control signal having a particular duty cycle as an initial value;

a second means, responsive to said throttle angle signal and to said engine speed signal, for correcting said control value in response to variation of the throttle valve angular position, said second means correcting said control value for increasing said duty cycle of said control signal at a given rate, which correction rate is a function of an engine speed signal value, responsive to a closing condition of said throttle valve angular position in which the angular position of said throttle valve is smaller than said predetermined open angle, and for thereafter decreasing said increased duty cycle of said control signal at a given rate and a given timing until the duty cycle returns to the particular initial value.

4. An auxiliary air flow rate control system for controlling idle speed of an internal combustion engine by controlling air flow rate through a bypass passage bypassing a throttle valve in a primary air induction passage, which system performs feedback control or open loop control of idle speed depending upon an engine driving condition, said system comprising:

auxiliary air control valve means inserted in said bypass passage for controlling air flow rate in said bypass passage;

an actuator incorporated with said auxiliary air control valve means and opening said control valve means in one of an energized or deenergized condition thereof and closing said control valve means in the other one of the energized or deenergized condition thereof;

first sensor for producing a first sensor signal indicative of an engine coolant temperature;

second sensor for detecting an angular position of the throttle valve and for producing a second signal upon variation of the throttle valve open angle through a predetermined angle;

microcomputer means operative upon a selected driving condition to perform open loop control for determining the auxiliary air flow rate based on said first signal value and for producing a control signal having a duty cycle representative of the determined auxiliary air flow rate, said microcomputer means being further operative for detecting an opening of said throttle valve exceeding said predetermined angle based on said second sensor signal and for increasing said auxiliary air flow rate when the throttle valve opening is detected as exceeding said predetermined angle, and thereafter gradually decreasing the auxiliary air flow rate at a given rate until the flow rate returns to its initial value.

5. An auxiliary air flow rate control system for controlling idle speed of an internal combustion engine by controlling air flow rate through a bypass passage bypassing a throttle valve in a primary air induction passage, which system performs feedback control or open loop control of idle speed depending upon an engine driving condition, said system comprising:

auxiliary air control valve means inserted in said bypass passage for controlling air flow rate in said bypass passage;

an actuator incorporated with said auxiliary air control valve means and opening said control valve means in one of an energized or deenergized condition thereof and closing said control valve means in the other one of the energized or deenergized condition thereof;

first sensor for producing a first sensor signal indicative of an engine coolant temperature;

second sensor for detecting an angular position of the throttle valve and for producing a second signal upon variation of the throttle valve open angle through a predetermined angle;

a microcomputer means operative upon a selected driving condition to perform open loop control for determining the auxiliary air flow rate based on said first signal value and for producing a control signal having a duty cycle representative of the determined auxiliary air flow rate, said microcomputer means being further operative for detecting a closing of said throttle valve to reduce the open angle thereof to a value smaller than said predetermined angle based on said second sensor signal and for increasing said auxiliary air flow rate when the throttle open angle is detected as being smaller than said predetermined angle, and thereafter gradually decreasing the auxiliary air flow rate at a given rate until the flow rate returns to its initial value.

6. An auxiliary air flow rate control system for controlling idle speed of an internal combustion engine by controlling air flow rate through a bypass passage by bypassing a throttle valve in a primary air induction passage, which system performs feedback control or open loop control of idle speed depending upon an engine driving condition, said system comprising:

auxiliary air control valve means inserted in said bypass passage for controlling air flow rate in said bypass passage;

an actuator incorporated with said auxiliary air control valve means and opening said control valve means in an energized condition and closing said control valve means in a deenergized condition thereof;

first sensor for producing a first sensor signal indicative of an engine coolant temperature;

second sensor for detecting an angular position of the throttle valve and for producing a second signal upon variation of the throttle valve open angle across a predetermined angle;

a microcomputer means operative upon a selected driving condition to perform open loop control for determining the auxiliary air flow rate based on said first signal value and for producing a control signal having a duty cycle representative of the determined auxiliary air flow rate, said microcomputer means being further operative for detecting a variation of said throttle valve angular position across said predetermined angle based on said second sensor signal and for increasing said auxiliary air flow rate when the throttle angle opening is detected as crossing said predetermined angle, and thereafter gradually decreasing the auxiliary air flow rate at a given rate until the flow rate returns to its initial value.

7. A control system as set forth in claim 1, 2 or 3, wherein said correction rate is determined by a table look up with respect to engine speed in a correction table predetermined as function of the engine speed.

8. A control system as set forth in claim 1, 2 or 3, wherein said correction rate is arithmetically calculated with respect to engine speed.

9. A control system as set forth in claim 1, 2 or 3, wherein said system further comprises a third means for determining engine driving condition to carry out correction of said duty cycle of said control signal responsive to acceleration and deceleration of the vehicle.

10. A control system as set forth in claim 9, including means providing a signal indicative of a transmission neutral switch position wherein said second means receives said transmission neutral safety switch position signal and is operative for correcting said control value corresponding to the transmission neutral switch position, vehicle speed and the engine coolant temperature.

11. A control system as set forth in claim 7, wherein said system further comprises a third means for determining an acceleration or deceleration driving condition of the engine and for correcting said duty cycle of said control signal responsive to acceleration or deceleration of the engine.

12. A control system as set forth in claim 8, wherein said system further comprises a third means for determining an acceleration or deceleration driving condition of the engine and for correcting said duty cycle of said control signal responsive to acceleration or deceleration of the engine.

13. The system as set forth in claim 11, 12 or 4, which further comprises a third sensor for producing a third signal representative of the engine speed, and wherein said microcomputer includes a memory means for storing a correction table to be read out with respect to a value of said third signal to correct said auxiliary air flow rate.

14. The system as set forth in claim 13, which further comprises a fourth sensor for producing a fourth signal when a transmission is shifted to neutral gear position and a fifth sensor for producing a fifth signal when a vehicle speed is less than a predetermined speed, and wherein said microcomputer means is further operative for distinguishing the engine driving condition based on said second, third, fourth and fifth signals and for selectively performing feedback and open loop control and for carrying out correction of the auxiliary air flow rate.

* * * * *